US012577017B2

(12) United States Patent
Girard

(10) Patent No.: US 12,577,017 B2
(45) Date of Patent: Mar. 17, 2026

(54) TUCK TOP SHIPPING MAILER BOX

(71) Applicant: Joshua Alan Girard, Andover, MN (US)

(72) Inventor: Joshua Alan Girard, Andover, MN (US)

( * ) Notice: Subject to any disclaimer, the term of this patent is extended or adjusted under 35 U.S.C. 154(b) by 0 days.

(21) Appl. No.: 18/227,947

(22) Filed: Jul. 30, 2023

(65) Prior Publication Data

US 2025/0033829 A1 Jan. 30, 2025

(51) Int. Cl.

| | |
|---|---|
| ***B65D 5/00*** | (2006.01) |
| ***B65B 5/04*** | (2006.01) |
| ***B65D 5/20*** | (2006.01) |
| ***B65D 5/50*** | (2006.01) |
| ***B65D 65/38*** | (2006.01) |

(52) U.S. Cl.

CPC ..... *B65D 5/5021* (2013.01); *B65B 5/04* (2013.01); *B65D 5/2052* (2013.01); *B65D 65/38* (2013.01); *B65D 2565/385* (2013.01)

(58) Field of Classification Search

CPC .... B65D 5/541; B65D 5/4266; B65D 5/5028; B65D 5/0227; B65D 5/5035; B65D 2543/00425; B65D 5/54; B65D 5/3621; B65D 5/3678; B65D 5/4295; B65D 5/46016; B65D 5/48012; B65D 5/5021; B65D 5/46072

USPC .... 206/223, 774, 216, 278, 459.5, 736, 746, 206/326, 485, 562, 591, 59, 4, 273; 53/284.5

See application file for complete search history.

(56) References Cited

U.S. PATENT DOCUMENTS

| | | | | |
|---|---|---|---|---|
| 5,678,695 | A * | 10/1997 | Ridgeway | B65D 5/5028 206/583 |
| 6,047,884 | A * | 4/2000 | Smith | B65D 5/48008 229/168 |
| 2003/0234252 | A1* | 12/2003 | Howard | B65D 5/6652 220/62.1 |
| 2019/0092513 | A1* | 3/2019 | de Boer | B31B 50/26 |

* cited by examiner

*Primary Examiner* — Jacob A Smith

(57) ABSTRACT

The present invention discloses a tuck top shipping mailer box with unsecured interior panels for secure contents placement and customizable as a folder-type box, characterized by its single-piece board construction wherein the bottom of the box serves as a hinge, forming all the walls and the cover of the packaging. The mailer box is designed as packaging cartons or boxes to securely hold contents in place without the need for conventional packing materials. The mailer box is crafted from various shipping box materials, including corrugated cardboard and corrugated plastic, and features unsecured interior panels created during the manufacturing process, traditionally via die-cut single sheets. The interior panels bend towards the interior of the box from the score point, utilizing the natural elasticity of the materials to automatically secure contents from the top and two sides with the fold-over interior panels.

12 Claims, 9 Drawing Sheets

TUCK TOP SHIPPING MAILER BOX

TECHNICAL FIELD

The present invention relates to the packaging industry in particular to the tuck top shipping mailer box and preparation of packaging cartons or boxes, designed with unsecured interior panels for secure contents placement and customizable folder-type box, characterized by its single-piece board construction wherein the bottom of the box serves as a hinge, forming all the walls and the cover of the packaging.

BACKGROUND ART

The rise of e-commerce and the increasing volume of goods being shipped globally have highlighted the importance of secure and efficient packaging. Traditional shipping boxes often lack versatility and may not adequately protect different types of products during transportation.

Many standard shipping boxes have fixed interior layouts or flimsy separators that can lead to product movement and damage during transit. This can result in increased shipping costs and customer dissatisfaction due to damaged goods.

Businesses dealing with diverse products often struggle with finding packaging solutions that can accommodate items of varying shapes and sizes. A customizable packaging design is highly sought after to streamline packing processes and reduce the need for multiple box sizes.

The art introduces unsecured interior panels that can be easily adjusted by the user. These panels provide a flexible layout, allowing the packer to create custom compartment based on the specific dimensions of the products being shipped.

Despite the unsecured nature of the interior panels, the design ensures that once the products are placed inside the box and the panels are properly positioned, the contents remain securely held in place during transportation. This minimizes the risk of product movement and damage.

The U.S. Pat. No. 8,409,064B2 of 2008 discloses a method and device for making boxes from a set of blanks for making a packaging box from two blanks (2, 3), wherein blanks are taken simultaneously from two adjacent stacks (25, 26) and placed on two parallel tracks (29, 30), the blanks are transferred flat until butted longitudinally to an assembly station, the first blank is glued on its way to the longitudinal abutment position, the first and second blanks are butted laterally into their respective positions to give them an exact lateral reference position, they are grasped, and transferred laterally, and the second blank is placed on the first blank which is thus indexed, escaping the drivers (61) of the first track (29) when the second blank is placed against the fast blank, but clamped by vertical pressure. The second blank is then applied to the first blank to glue them together in their respective defined longitudinal positions, and the resulting set of blanks is then transferred to an erecting station where the box is erected by rolling the blanks around a core.

Another U.S. Pat. No. 11,235,903B2 of 2016 describes a stackable receptacle for the shipment of goods. Embodiments of a reusable stackable shipping box are provided herein. The reusable stackable shipping box may be reused and cleaned without causing harm to the integrity of the box. In addition, the box is slightly tapered in shape such that the box may be stacked upon and within other boxes for ease in shipping and organization.

However, the subject matter being disclosed in the above prior art fails to describe what is being proposed in the present invention.

There is therefore need for a customizable dimensions of the shipping box offer cost-effective packaging solutions. Businesses can use the same type of box for various products, eliminating the need for packing materials and streamlining the packing process.

The design focuses on user-friendliness, making it easy for packers to create a secure interior layout for different products. Additionally, the easy opening and closing mechanisms contribute to a positive unboxing experience for customers.

Depending on the materials used, the design may incorporate eco-friendly options, aligning with the growing demand for sustainable and environmentally conscious packaging solutions.

OBJECTS OF THE INVENTION

The primary object of the invention is to provide a tuck top shipping mailer box, a shipping box with unsecured interior panels that ensure secure content placement during transit by allowing users to create custom compartment and adjust the interior layout, the invention aims to prevent product movement, minimizing the risk of damage and enhancing the security of the shipped items.

Another object of the invention is to offer a packaging solution with customizable dimensions by providing the flexibility to adjust the interior space, the invention caters to various products of different shapes and sizes, reducing the need for multiple box types and streamlining the packing process.

The invention seeks to provide a versatile and cost-effective packaging solution businesses that can use the same type of shipping box for a wide range of products, simplifying inventory management and reducing packaging costs.

An object of the invention is to offer a user-friendly design that simplifies the packing and unboxing processes for the unsecured interior panels are easy to adjust, allowing packers to efficiently create a secure layout, while recipients can easily open and access the contents without difficulty.

Another object is to optimize space utilization within the shipping box, avoiding unnecessary voids, and ensuring efficient use of materials. Depending on the materials used, the invention may also incorporate eco-friendly and sustainable options, promoting environmentally conscious packaging practices.

The invention aims to protect products during shipping and minimize the risk of damage. The secure contents placement and customizable interior ensure that items are held firmly in place, reducing the chance of breakage or movement during transit. The invention seeks to cater to diverse industries and product types. It can be used for shipping electronics, fragile items, clothing, cosmetics, and other goods, providing a solution that adapts to various market segments.

By ensuring secure contents placement, the invention aims to reduce the likelihood of products getting damaged during shipping. This can lead to a decrease in product returns and associated costs for businesses.

By achieving these objectives, the tuck top shipping mailer box presents a novel and practical packaging solution, meeting the needs of businesses in a dynamic and competitive shipping environment. The patent application will emphasize how these objects distinguish the invention from existing packaging designs, making it a valuable and innovative contribution to the industry.

The invention may incorporate features that allow for branding and personalization, contributing to a positive unboxing experience for customers and reinforcing brand identity.

The following summary is an explanation of some of the general inventive steps for the system, method, architecture and container in the description. This summary is not an extensive overview of the invention and does not intend to limit the scope beyond what is described and claimed as a summary.

SUMMARY OF THE INVENTION

The tuck top shipping mailer box with unsecured interior panels for secure contents placement and customizable dimensions is an innovative and versatile packaging solution designed to address the challenges faced in the shipping and packaging industry. The invention offers enhanced security and flexibility, providing a customizable interior layout while ensuring secure content placement during transit.

The tuck top shipping mailer box with unsecured interior panels for secure contents placement and customizable dimensions stands out as a novel and practical packaging solution with several advantages over traditional shipping boxes: Traditional boxes often lack flexibility, whereas the invention offers customizable dimensions and interior layouts, adapting to diverse product types.

Fixed interior layouts in standard boxes may lead to product movement during transit, potentially causing damage. Additionally, use of packing materials introduces increase in waste and cost. The unsecured interior panels in the invention provide enhanced security without restricting customization or need for packing materials.

The ability to use the same box for various products increases cost efficiency and reduces the need for extensive packaging inventory.

The packaging solution emphasizes user-friendliness, simplifying both the packing process and the unboxing experience for customers.

The preceding summary is intended to serve as an introduction to some embodiments of the invention. It is not meant to be an overview of all inventive subject matter disclosed in this specification. The detailed description that follows and the drawings that are referred to in the detailed description will further describe the embodiments described in the summary as well as other embodiments. Accordingly, to understand all the embodiments described by this document, a full review of the summary, detailed description and drawings is needed.

BRIEF DESCRIPTION OF THE DRAWING

The novel features believed to be characteristic of the illustrative embodiments are outlined in the appended claims. The illustrative embodiments, however, as well as a preferred mode of use, further objectives, and descriptions thereof, will best be understood by reference to the following detailed description of one or more illustrative embodiments of the present disclosure when read in conjunction with the accompanying drawings.

DESCRIPTION OF THE PREFERRED INVENTION

In the following detailed description of the invention, numerous details, examples, and embodiments of the invention are described. However, it will be clear and apparent to those knowledgeable in the field that the invention is not limited to the embodiments set forth and that the invention can be adapted for a wider range of applications.

The present invention provides a tuck top shipping mailer box that is created from various materials, including corrugated cardboard and corrugated plastic, comprising an exterior structure with an external top panel, four external side panels, an external bottom panel, and an interior structure featuring interior panels with scored flex points.

The external top panel, four external side panels, and external bottom panel are crafted from the selected material, forming the lid, four sides, and base of the box, respectively. When assembled, they create a fully enclosed container with the top, four sides, and bottom securely in place.

According to FIG. 1-FIG. 10, the interior panels of the tuck top shipping mailer box are designed to bend towards the interior of the box from the score point, utilizing the natural elasticity of the materials to automatically secure contents from the top and two sides with the fold-over interior panels. By leaving the interior panels unsecured, they act as flexible barriers that provide resistance to the contents inside the box, holding them securely during transit without the need for additional packing materials.

Figure 1:
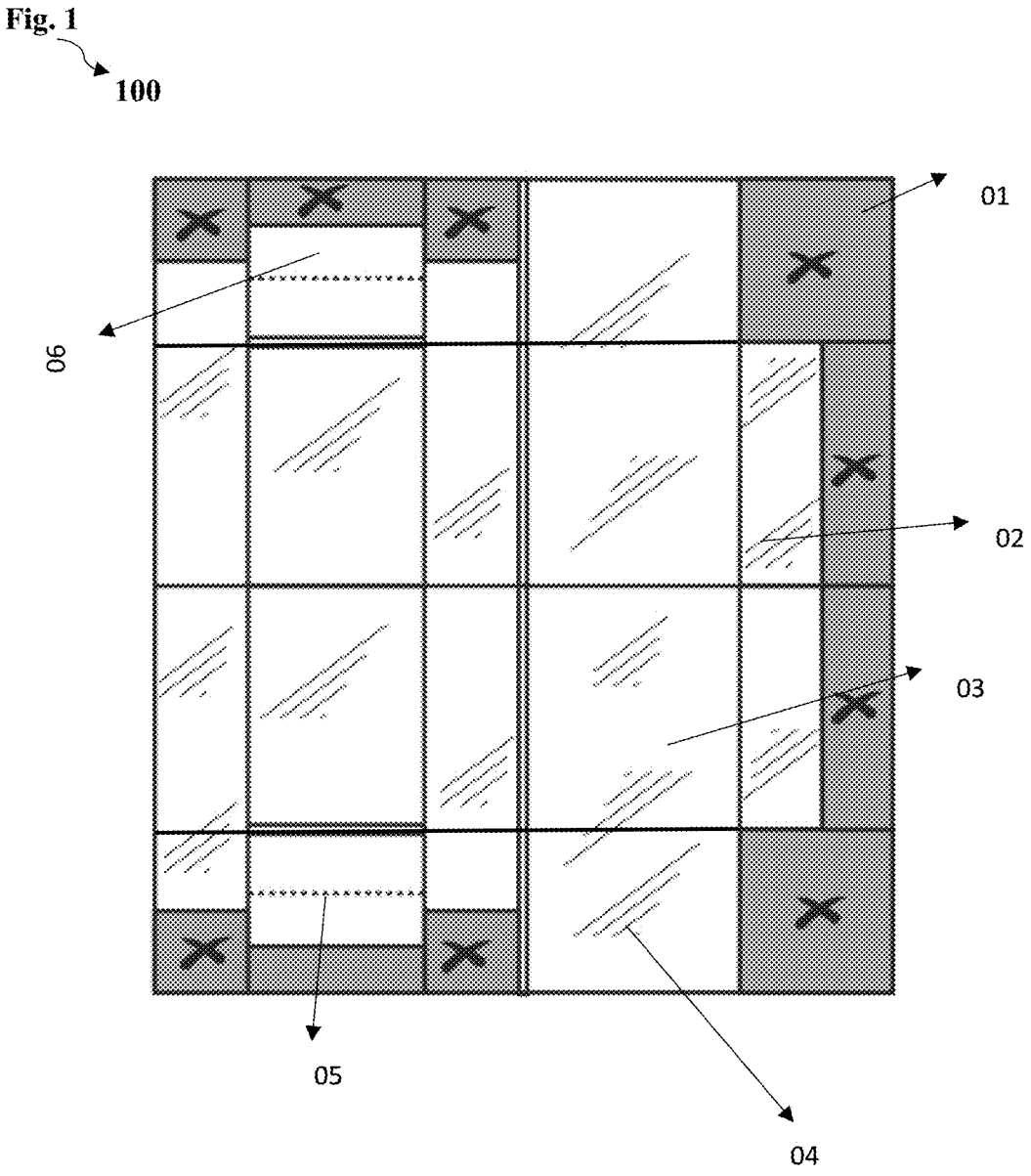
FIG. 1 shows an outline of uncut open layout view of the tuck top shipping mailer box made of cardboard.

In FIG. 1, the invention illustrates an outline of uncut open layout view of the tuck top shipping mailer box made of cardboard. It demonstrates the excess material 01 on the outer portion of the tuck panel flap 02, top cover panel 03 and the top interior panel 04. It also shows the location the side wall fold score 05 and side wall interior panel 06.

Figure 2:
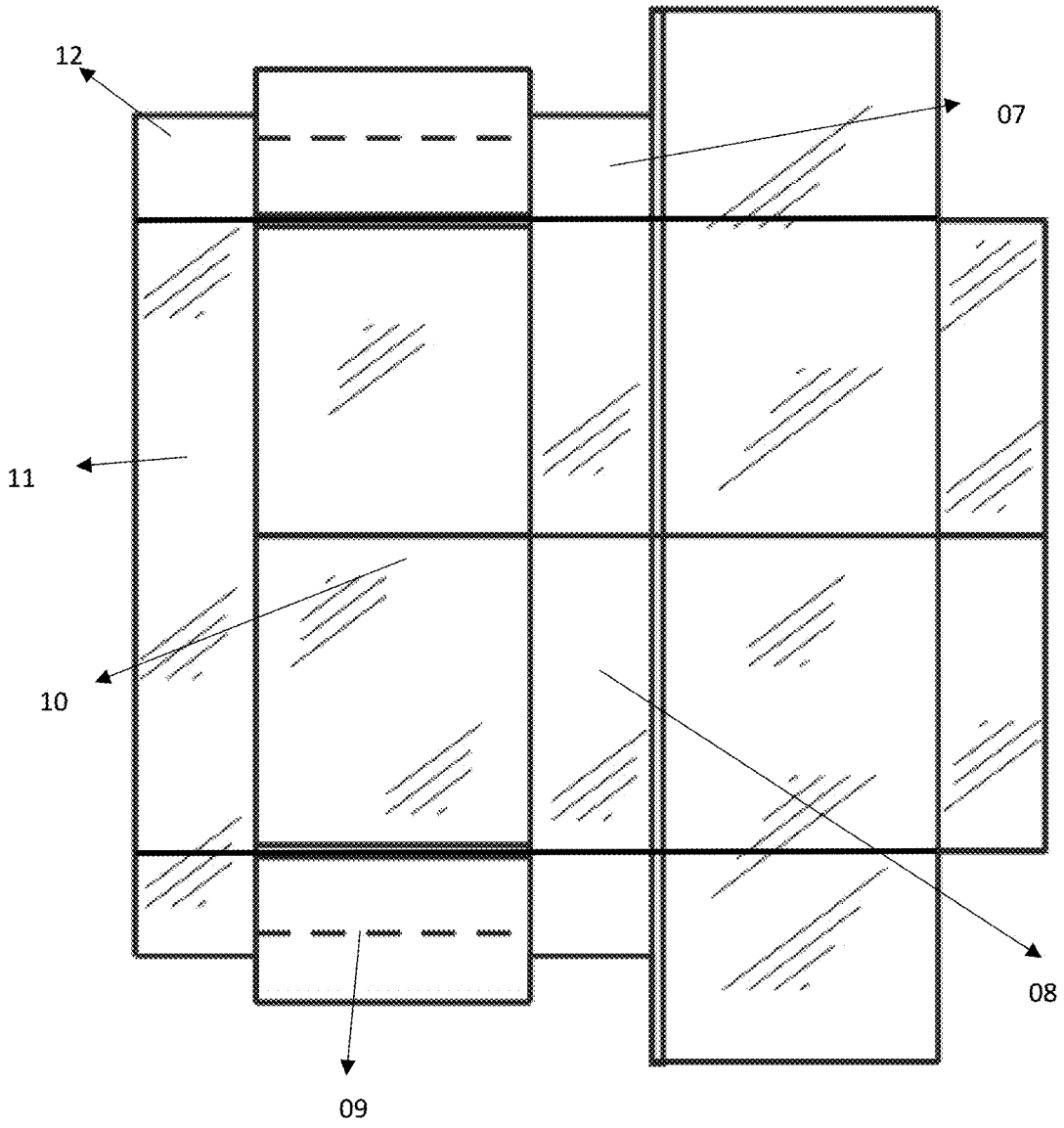
FIG. 2 shows the outline of the cut open layout view of the tuck top shipping mailer box.

In FIG. 2, the invention shows the outline of the cut open layout view of the mailer box panels. It illustrates the position of rear panel interior flap 07 and rear panel 08 adjacent to side wall exterior panel 09 and bottom panel 10. Also disclosed is the front panel 11 attached to the front exterior panel.

Figure 3:
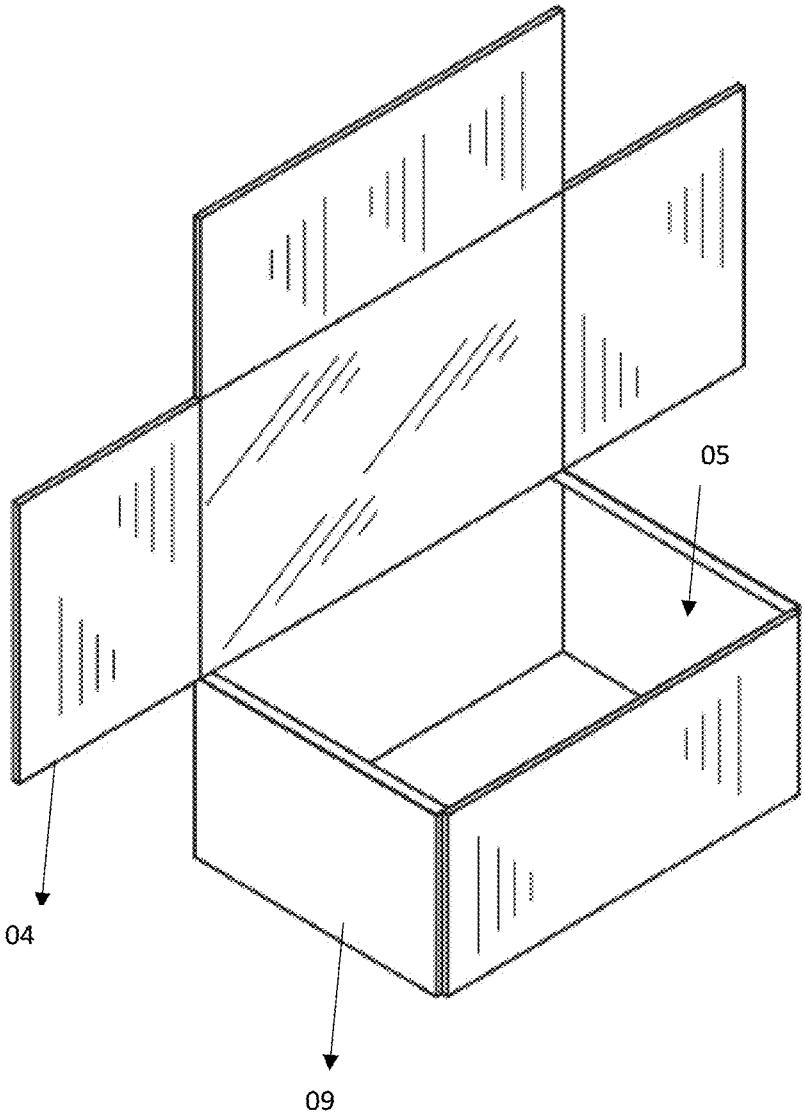
FIG. 3 shows the perspective view of open folded cardboard mailer box with unsecured side panels aligned with side wall and top unsecured panels unfolded.
Figure 4:
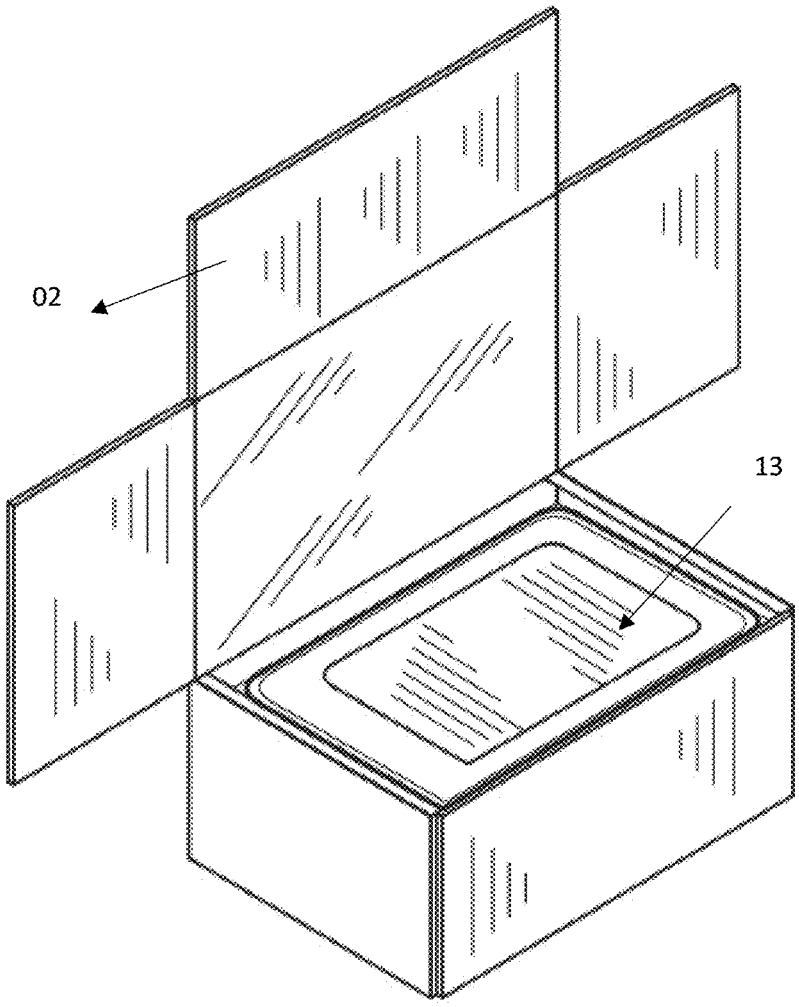
FIG. 4 shows a perspective view of open mailer box of cardboard containing cards.
Figure 5:
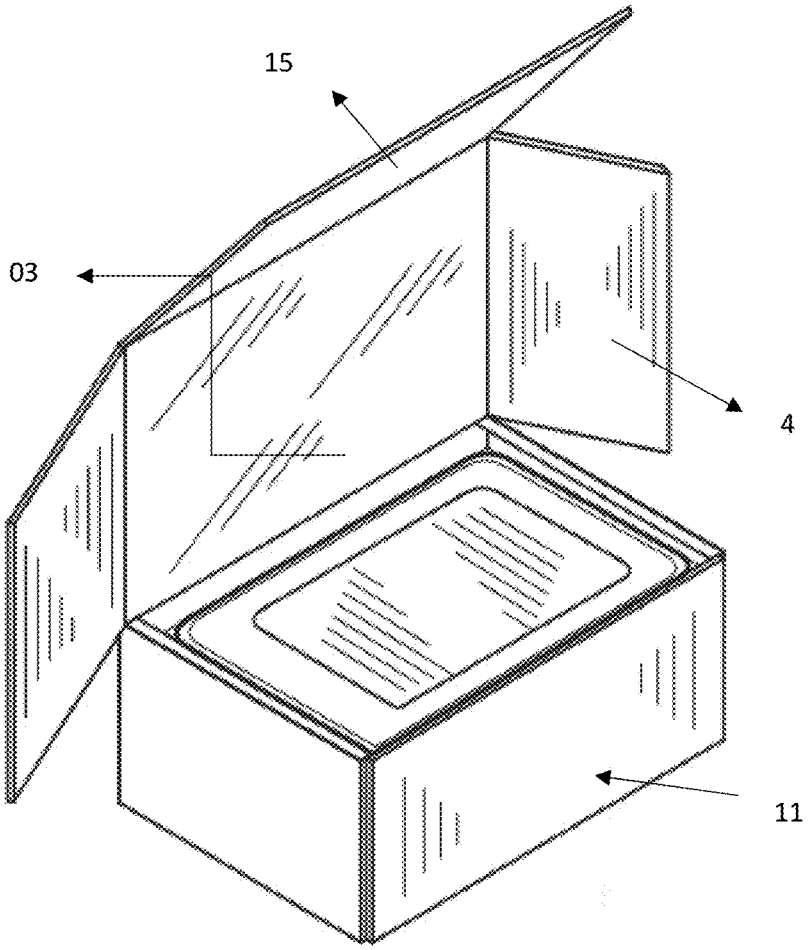
FIG. 5 shows a perspective view of semi closed mailer box of cardboard with unsecured top panels and tuck flap folding towards interior.

In FIG. 3, the invention shows the perspective view of open folded interior side view panels of the mailer box. It demonstrates a side interior panel fit to inner exterior wall 05, side wall 09 and top interior panel 04. In FIG. 4, the invention shows a perspective view of open flap of the mailer box cardboard containing cards. It shows the tuck panel flap 02 and contents contained by side interior panels 13. In FIG. 5, the invention shows a perspective view of semi closed flaps of the mailer box cardboard. It indicates the front panel 11, top cover panel interior 03 and top interior panel 04 covered by the exterior flap 15.

Figure 6:
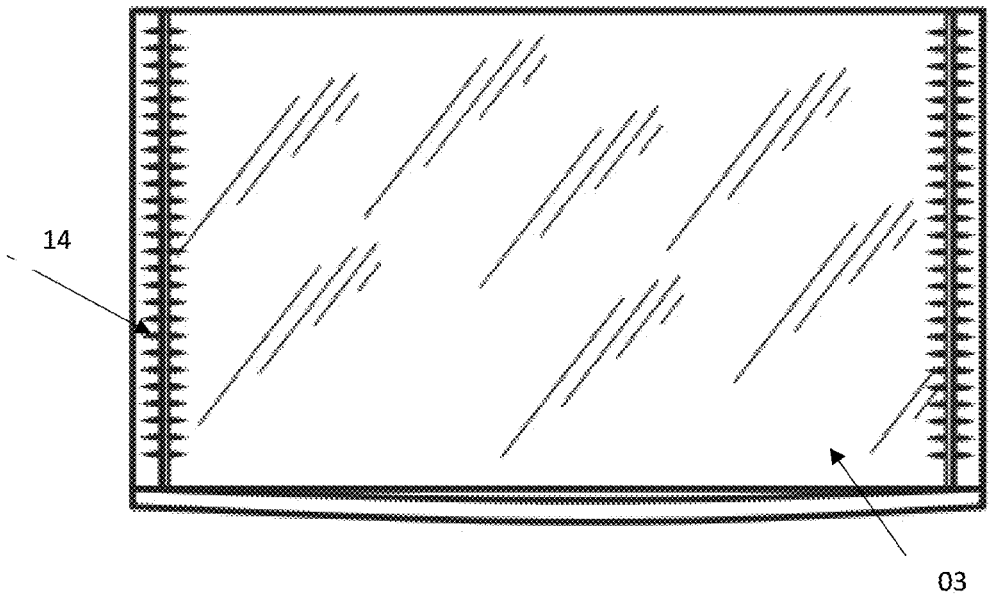
FIG. 6 shows a top view of closed mailer box of cardboard.
Figure 7:
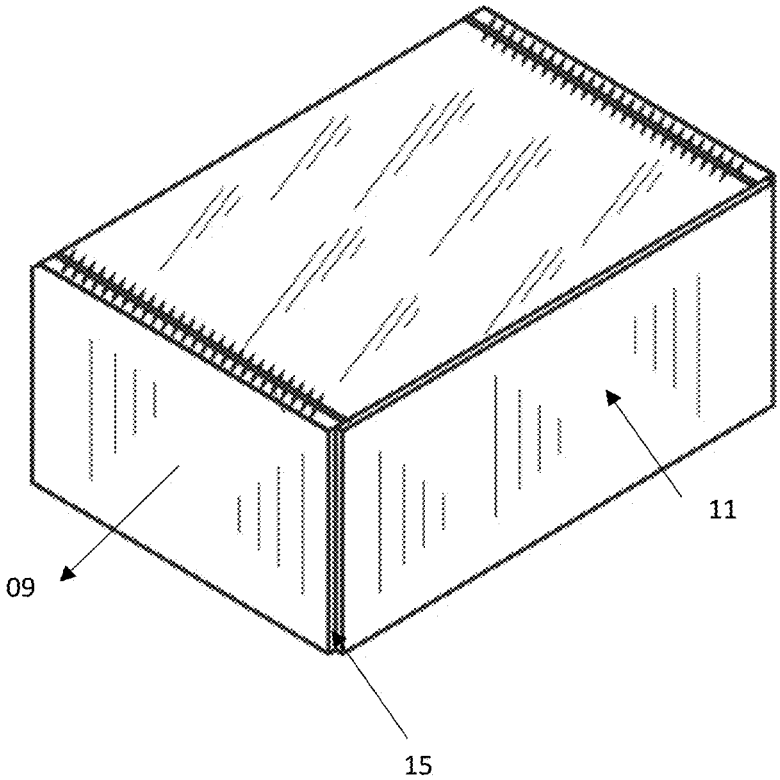
FIG. 7 shows the perspective view of closed mailer box of cardboard.

In FIG. 6, the invention shows a top view of closed mailer box showing enclosed side seams 14 and top cover (lid) 03. In FIG. 7, the invention shows the perspective view of closed folded mailer box showing panels such as side wall panel 09, front panel 11 and front panel interior flap seam 15.

Figure 8:
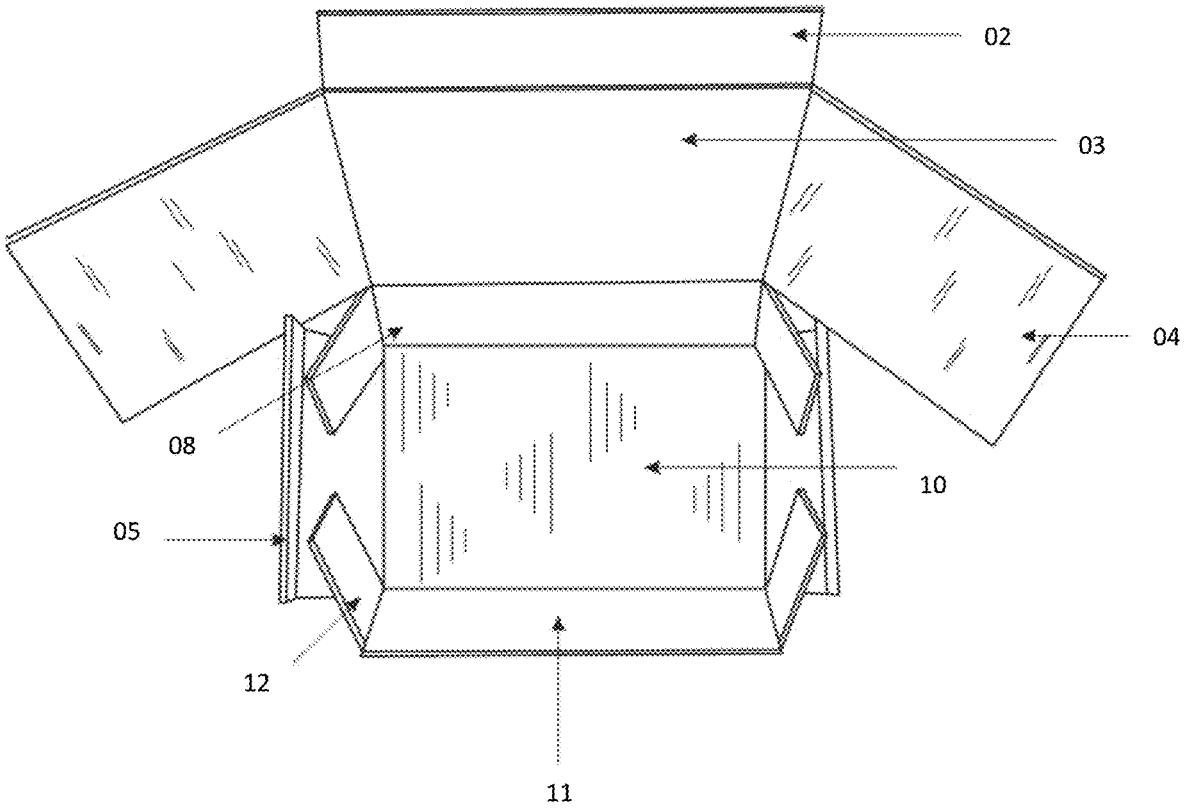
FIG. 8 shows top view of semi folded mailer box of cardboard.

In FIG. 8, the invention shows top view of opened flaps of the mailer box showing top unsecured interior panel 04 attached to the top cover panel interior 03, tuck flap interior 02 and top unsecured interior panel 04. Just below the top cover is the back side panel interior 08 above the bottom panel interior 10, side panel interior, front side panel interior 11, side interior flap 12 and side unsecured interior panel 05.

Figure 9:
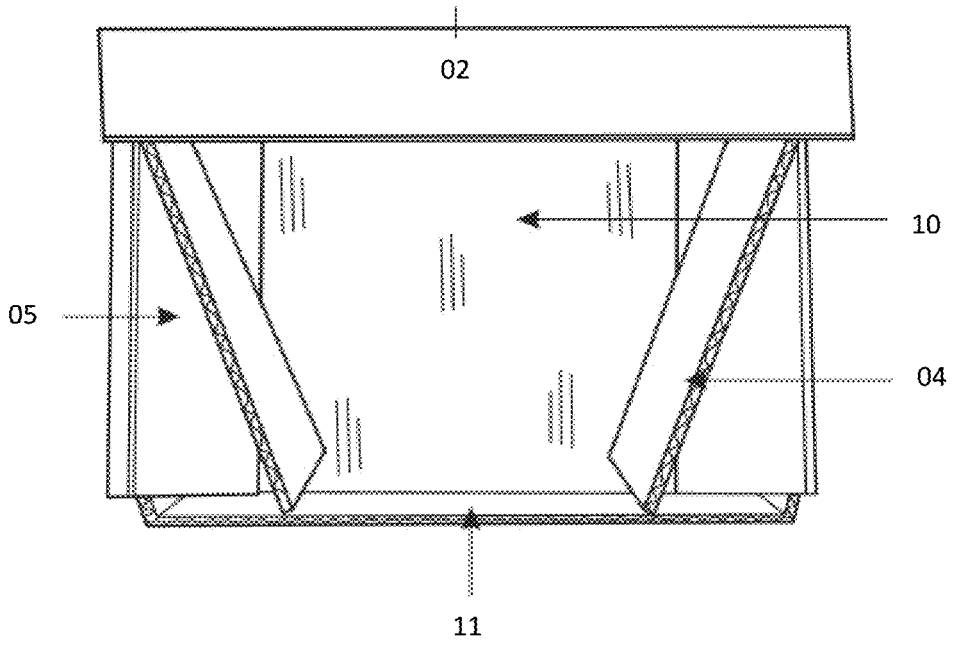
FIG. 9 shows top view of folded mailer box of cardboard with cover open.

In FIG. 9, the invention shows a top view of a folded mailer box showing side unsecured interior panel 05, front side panel interior 11 adjacent to the top unsecured interior panel 04 and tuck flap exterior 02 above the bottom panel interior 10.

Figure 10:
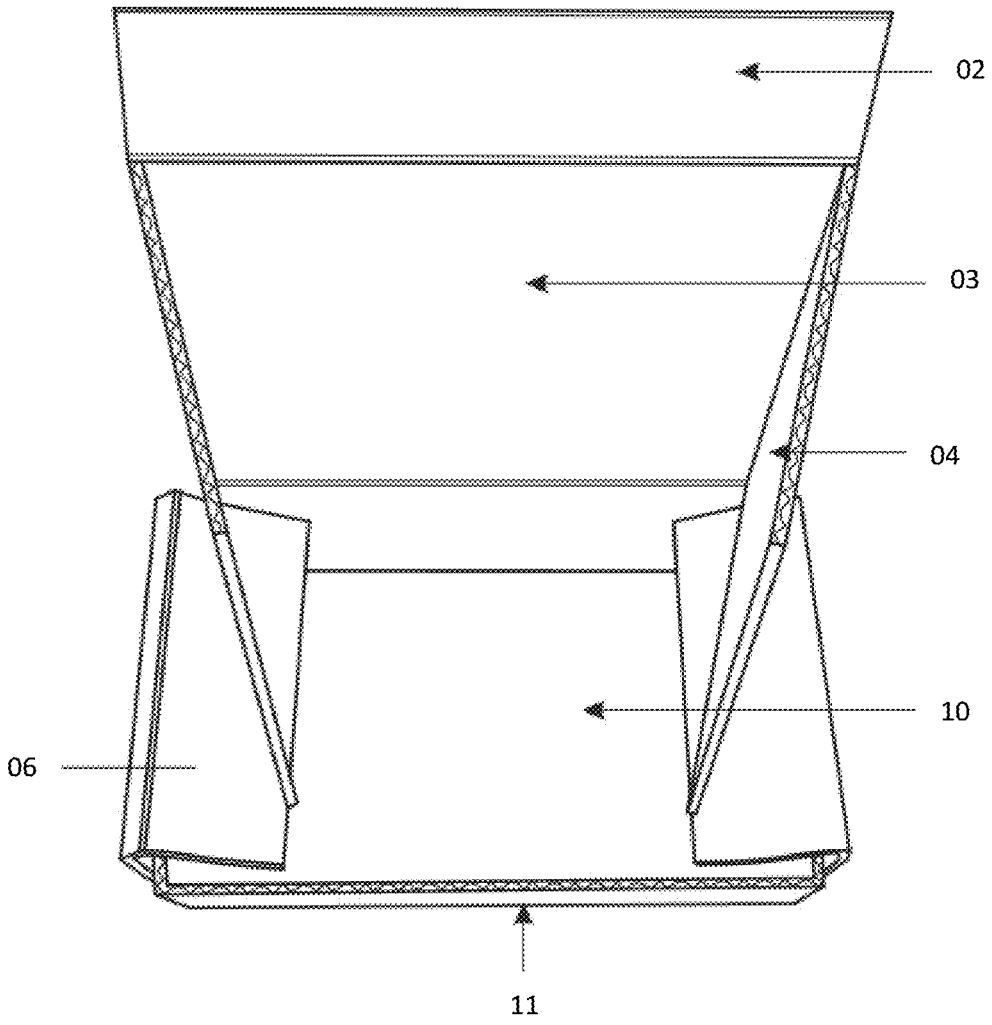
FIG. 10 shows a perspective top view of folded mailer box of cardboard with cover open.

FIG. 10 shows a perspective view of a closed mailer box having tuck panel flap 02, top cover panel (lid) 03, top interior panel 04, bottom panel 10 next to the front panel 11 and side wall interior panel 06.

The height, length, and depth of the mailer box for shipping are customizable to accommodate various product sizes and dimensions. This strategic design feature ensures a proper fit and secure placement of contents within the box.

The manufacturing process for the external and interior structures allows for a high degree of customization. Engineers or design specialists can tailor the height, length, and depth of the box, to meet specific packaging needs, offering a versatile packaging solution for various products.

Moreover, the internal and external surfaces of the box can be further customized by adding graphics, product information, warnings, or company logos. This personalization enhances the visual appeal of the packaging and creates branding opportunities. The shipping box with unsecured interior panels offers several advantages:

1. Complete protection: The box has 5 fully enclosed sides and one open side (the top), ensuring maximum protection of the contents during transit.
2. Versatile fit: Interior panels bend towards the interior of the box from the score point, utilizing the natural elasticity of the materials to automatically secure contents from the top and two sides with the fold-over panels.
3. Enhanced security: The unsecured interior panels act as barriers that provide resistance to the contents inside the box, eliminating the need for additional packing materials.
4. Cost-effective and eco-friendly: Eliminating the requirement for packing materials reduces overall shipping costs and minimizes environmental impacts.
5. Efficient assembly: The box can be easily assembled, saving packing time and streamlining the shipping process.
6. Customizable: The highly customizable height, length, and depth of the box allow for tailored packaging solutions and branding opportunities.

The side of the tuck top shipping mailer box has unsecured interior panels, which presents an innovative packaging solution that works with various materials, including corrugated cardboard and corrugated plastic. It eliminates the need for packing materials while ensuring secure and safe shipping. This patent will protect the unique design, incorporating unsecured interior panels and customizable dimensions, offering cost-effectiveness, environmentally friendly practices, efficient shipping solutions, and versatile packaging options for a wide range of goods and products. With its complete protection, adaptable fit, and other advantages, this shipping box promises to revolutionize the packaging industry, providing businesses and consumers with a reliable, sustainable, and customizable solution for shipping and transporting goods.

The fold or score is part of traditional die-cut boxes. The focus here is the unsecured interior panels that utilize natural elasticity to secure the contents of the box. The unsecured panels may be any size not exceeding the interior length or height of the exterior panel.

Die-cut boxes prior art are innovative packaging solutions achieved through the die-cutting process, enabling the creation of diverse packaging options regardless of size, material, fold, or functionality. A die-cut box is fabricated using a specialized machine known as a die cutter or die press, which precisely cuts corrugated cardboard into box shapes. Unlike traditional regular slotted container ("RSC") boxes, die-cut boxes offer a broader spectrum of shapes and styles. One notable advantage of die-cut mailer boxes is their ability to be tailored precisely to the product's dimensions, potentially reducing shipping costs and eliminating the need for additional foam or packing materials. Moreover, these boxes feature double-padded walls, providing enhanced protection for the enclosed products.

The construction of die-cut boxes ensures that their walls firmly lock into place, while the lid typically closes with a tab, contributing to their superior structural integrity and reducing the necessity for excessive tape application as seen in RSC boxes. This inherent strength renders die-cut boxes an ideal choice for safeguarding fragile items during international shipping, where the package may undergo more rigorous handling.

Die-cut boxes empower companies with the flexibility to unleash their creativity, allowing for fully customizable appearances, including the option to print logos and instructions on the packaging. From a customer standpoint, die-cut boxes deliver an engaging experience, offering potential customization on the inside and even the possibility of incorporating graphics. Additionally, the reduced reliance on tape facilitates easier box opening for end consumers. This personalized customer experience has made custom die-cut boxes highly sought-after for premium and luxury brands.

The present invention is classified as a folder-type box, characterized by its single-piece board construction. The bottom of the box serves as a hinge, forming all the walls and the cover of the packaging.

Advantages of the Invention

E-commerce and Retail: In the booming e-commerce and retail sectors, the shipping box's adaptability and secure content placement are highly beneficial. Businesses dealing with diverse products can use a single type of box for multiple items, reducing packaging costs and simplifying logistics.

Electronics and Fragile Items: The invention is ideal for shipping delicate electronics and fragile items. The adjustable interior layout ensures these items are securely held in place during transit, minimizing the risk of damage.

Fashion and Apparel: Clothing and fashion retailers can use customizable dimensions to accommodate various apparel items, including garments of different sizes and shapes.

Cosmetics and Beauty Products: For the cosmetics industry, the packaging solution allows for the safe shipping of various beauty products, such as makeup, skincare items, and perfumes, regardless of their size and form.

Home Goods and Furnishings: The invention finds application in shipping household items and furnishings, providing a secure and tailored packaging solution for items like ceramics, glassware, and small furniture pieces.

Consumer Goods and Gifts: Manufacturers and retailers of consumer goods and gifts can benefit from the invention's versatility, as it can accommodate a wide range of products with varying dimensions.

Technology and Gadgets: Businesses dealing with technology gadgets, such as smartphones, tablets, and accessories, can use the packaging solution to ensure the safe transit of their products.

Automotive and Parts: The invention can be used to ship automotive parts and components, ensuring they reach their destination securely and without damage.

Food and Beverage Industry: The packaging solution can also find applications in the food and beverage industry for shipping items like artisanal chocolates, gourmet items, and small bottles of beverages.

In some embodiments, the multi-purpose, on-demand, digital QR code generating device as presently disclosed, can be widely adapted for use in various industries. While the invention has been described with reference to numerous specific sensors, one of ordinary knowledge in the field will recognize that the invention can be embodied in other specific forms without departing from the spirit of the invention. Specific operations may not be performed in one continuous series of operations, and different specific operations may be performed in different embodiments. Furthermore, the processes or methods could be implemented using several sub-processes, or as part of a larger macro process. Thus, one of ordinary knowledge in the field would understand that the invention is not to be limited by the foregoing illustrative details, but rather is to be defined by the appended claims.

INDUSTRIAL APPLICATION

The present invention applies to mail boxes. It applies to the tuck top shipping mailer box with unsecured interior panels for secure contents placement and customizable dimensions and presents numerous opportunities for various industries. The shipping box with unsecured interior panels for secure contents placement and customizable dimensions has broad industrial applications, catering to diverse businesses and industries. Its ability to provide enhanced security, flexibility, cost-efficiency, and improved user experience positions it as an innovative and valuable packaging solution for the modern shipping environment. The invention's adaptability across various sectors makes it a competitive and sought-after option for businesses seeking reliable and efficient packaging solutions.

What is claimed:

1. A tuck top shipping mailer box, comprising:

an exterior structure having an external top panel, four external side panels, an external bottom panel; and an interior structure featuring a plurality of unsecured fold-over interior panels having scored flex points, wherein said unsecured interior panels are configured to bend towards the interior of the box from the scored flex points, utilizing a natural elasticity of the material to automatically secure contents from a top and two sides by providing resistance to the contents inside the box without requiring additional packing materials.

2. The tuck top shipping mailer box of claim 1, wherein said unsecured fold-over interior panels are made from a material selected from the group consisting of corrugated cardboard and corrugated plastic, enabling easy adjustment and repositioning due to their unsecured configuration to create custom compartments tailored to the specific dimensions and shapes of the products being shipped.

3. The tuck top shipping mailer box of claim 1, wherein once products are placed inside and the unsecured fold-over interior panels are positioned, said panels automatically secure the contents by bending towards the interior of the box and providing resistance, thereby minimizing the risk of product movement and damage during transit.

4. The tuck top shipping mailer box of claim 3, wherein the automatic securement by the unsecured fold-over interior panels provides an enhanced security for shipping delicate and fragile items, electronics, cosmetics, thereby preventing breakage.

5. The tuck top shipping mailer box of claim 4, wherein a customizable height, length, and depth of the box, enabled by the adjustable unsecured fold-over interior panels, allows businesses to use a single type of box for various products, resulting in cost-efficiency, reduced packaging inventory, and simplified logistics in inventory management and shipping operations.

6. The tuck top shipping mailer box of claim 4, wherein said unsecured interior panels are configured for easy adjustment and arrangement within the box to create a secure compartment, thereby providing a packaging design that simplifies a packing process for packers, ensuring efficient packing and minimizing packing time.

7. The tuck top shipping mailer box of claim 6, wherein the packaging design is a user-friendly packaging design that provides easy opening and closing mechanisms, thereby offers a seamless unboxing experience for recipients, enhancing customer satisfaction, and contributing to a positive brand impression during product delivery.

8. The tuck top shipping mailer box of claim 7, wherein the packaging design consists of an eco-friendly packaging solution, utilizing recyclable and environmentally conscious materials, is designed to appeal to environmentally conscious consumers and businesses aiming to reduce their carbon footprint and contribute to sustainable packaging practices.

9. The tuck top shipping mailer box of claim 7, wherein the box is a folder-type box, characterized by its single-piece board construction from a material selected from the group consisting of corrugated cardboard and corrugated plastic, where the exterior structure, including the external top panel, four external side panels, and external bottom panel, is formed from said single piece.

10. The tuck top shipping mailer box of claim 7, wherein the bottom panel of the exterior structure serves as a hinge, from which all external side panels and the external top panel are integrally formed.

11. A method of securely packaging products for transportation using a tuck top shipping mailer box comprising a plurality of unsecured fold-over interior panels having scored flex points, the method comprising steps of:

positioning the unsecured fold-over interior panels to create a custom compartment;

placing the products inside the shipping box; and automatically securing the contents in place during transit by said unsecured fold-over interior panels bending towards the interior of the box from their scored flex points and utilizing their natural elasticity to provide resistance to the contents, thereby minimizing a risk of product movement and damage.

12. The method of claim 11, wherein the step of automatically securing the contents in place during transit results in reducing a risk of product damage during transportation and enhancing product protection, thereby leading to improved customer satisfaction and reduced product returns.

* * * * *